United States Patent [19]

Sakamaki et al.

[11] Patent Number: 4,883,079

[45] Date of Patent: Nov. 28, 1989

[54] MAKE-UP TOOL AND HOLDER ASSEMBLY

[75] Inventors: Yosio Sakamaki, Nagareyama; Yuji Ideshita, Yokohama; Fumiyoshi Fujita, Soka; Takashi Sugiyama, Kodaira, all of Japan

[73] Assignee: Yoshida Industry Co., Ltd., Tokyo, Japan

[21] Appl. No.: 162,709

[22] Filed: Mar. 1, 1988

[30] Foreign Application Priority Data

| | | | |
|---|---|---|---|
| Sep. 18, 1987 | [JP] | Japan | 62-141577 |
| Sep. 18, 1987 | [JP] | Japan | 62-141578 |
| Sep. 18, 1987 | [JP] | Japan | 62-141579 |
| Oct. 15, 1987 | [JP] | Japan | 62-156791 |
| Oct. 15, 1987 | [JP] | Japan | 62-156792 |

[51] Int. Cl.[4] ..... A45D 40/24

[52] U.S. Cl. ..... 132/318; 132/310

[58] Field of Search ..... 132/318, 317, 310, 311, 132/312, 297, 76.2, 314

[56] References Cited

U.S. PATENT DOCUMENTS

| | | | |
|---|---|---|---|
| 1,534,497 | 4/1925 | Boorman | 132/297 |
| 1,641,263 | 9/1927 | Friedman | 132/312 |
| 2,491,207 | 12/1949 | Preble, Jr. et al. | 132/311 |
| 2,523,028 | 9/1950 | Kend | 132/76.2 |
| 2,534,100 | 12/1950 | Baumgartner | 132/317 |
| 2,775,248 | 12/1956 | Morrell | 132/312 |
| 3,760,820 | 9/1973 | Seidler | 132/317 |
| 4,362,174 | 12/1982 | Baker et al. | 132/310 |
| 4,467,822 | 8/1984 | Blackwell | 132/311 |
| 4,620,558 | 11/1986 | Luttgiens | 132/317 |

FOREIGN PATENT DOCUMENTS

| | | |
|---|---|---|
| 59-193310 | 12/1984 | Japan . |
| 60-12315 | 1/1985 | Japan . |
| 61-163525 | 10/1986 | Japan . |

*Primary Examiner*—Paul J. Hirsch

*Attorney, Agent, or Firm*—Wenderoth, Lind & Ponack

[57] ABSTRACT

A make-up tool and holder assembly includes a holder body substantially in the shape of a plate, a plurality of cavities formed in the holder body through the entire thickness thereof, and a plurality of tools each having at one end thereof a make-up head and having a dimension capable of being accommodated in a respective cavity. The tools are arranged to be secured in the cavities in a detachable manner so that any desired tool can be separated from the holder body for use alone.

6 Claims, 9 Drawing Sheets

MAKE-UP TOOL AND HOLDER ASSEMBLY

BACKGROUND OF THE INVENTION

1. Field of the Invention

The present invention relates to a portable assembly holding a plurality of make-up tools for applying cosmetic materials to a human face, nail or other area.

2. Description of the Prior Art

Conventionally a make-up tool such as a brush has been contained in a vanity case together with a cosmetic material. However, recent developments are such that consumers tend to prefer a vanity case containing plural cosmetic materials of different sorts or of different colors. Such a tendency also requires that plural make-up tools be carried with the vanity case, but a fundamental requirement regarding size of the vanity case prevents it from being so enlarged as to be sufficient to contain plural tools together with the several kinds of cosmetic materials.

In view of the above situation, there has been proposed a make-up tool and holder assembly for carrying plural tools separately from the vanity case. One such assembly is disclosed in Japanese Utility Model KOKAI No. 59-193310, in which a holder comprises a pair of plates connected to each other by a pin to which ends of plural tools are permanently and integrally pivotted. The pin is so located that the tools are usually positioned between the plates. When a user wishes to perform a make-up operation, any desired tool is rotated about the pin until a head thereof is positioned opposite to the plates with respect to the pin.

Japanese Utility Model KOKAI No. 60-12315 discloses another assembly in which plural tools are arranged on a cylindrical holder along the circumferential directon thereof and are integrally pivotted at one end to lower edge of the holder. When desired, any of the tools can be rotated about the pivot so as to project downwardly from the holder for use in a make-up separation.

Further, Japanese Utility Model KOKAI No. 61-163525 discloses a tool assembly comprising a pair of brushes which are pivotably and integrally connected to each other at the base ends thereof. The brushes can be aligned with each other where the heads are positioned at opposite ends of the assembly for use thereof, and can be arranged side-by-side for storage or carriage.

In all of the above prior art arrangements the tool is integrally connected to the holder or to another tool, and it is therefore impossible to use the desired tool alone separately from the holder and other tools. This more or less detracts from the operability of the tool, particularly when a delicate make-up operation is needed. Additionally, the prior art holder increases the thickness of the assembly, resulting in an inconvenience when carrying the assembly in a hand bag or other small bag.

Accordingly, an object of the present invention is to provide a make-up tool and holder assembly which makes it possible to carry a plurality of tools apart from a vanity case and in which any desired tool can be separated from a holder for use alone.

Another object of the invention is to provide an assembly in which tools may be separated from and attached to a holder by simple operations.

A further object of the invention is to provide an assembly the thickness of which can be reduced substantially to a thickness of the tool.

SUMMARY OF THE INVENTION

According to the invention, a make-up tool and holder assembly comprises a holder body substantially in the shape of a plate, a plurality of cavities formed in the holder body through the entire thickness thereof, a plurality of tools each having at one end thereof a make-up head and having a dimension capable of being accommodated in a respective cavity, and menas for securing the tool in the cavity in a detachable manner.

During use, any desired tool can be separated from the holder body and can be used alone, thus improving operability of the tool. The arrangement that the tools are accommodated in the cavities formed through the entire thickness of the holder body makes it possible to reduce a thickness of the assembly to a minimum level.

In certain embodiments of the invention, the cavity is entirely surrounded by the marginal walls of the holder body. The securing means may include a flexible hinge portion which permits at least a part of the tool including the head to project over the holder body. Alternatively, the securing means may comprise means for pivotably connecting the tool to the holder body.

Other objects, features and advantages of the invention will be apparent from the following description of preferred embodiments thereof when taken in conjunction with the accompanying drawings.

DESCRIPTION OF THE PREFERRED EMBODIMENTS

Figure 1:
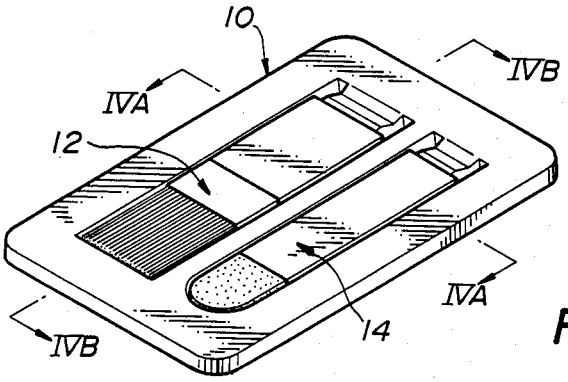
FIG. 1 is a schematic perspective view illustrating a make-up tool and holder assembly according to a first embodiment of the invention.
Figure 2:
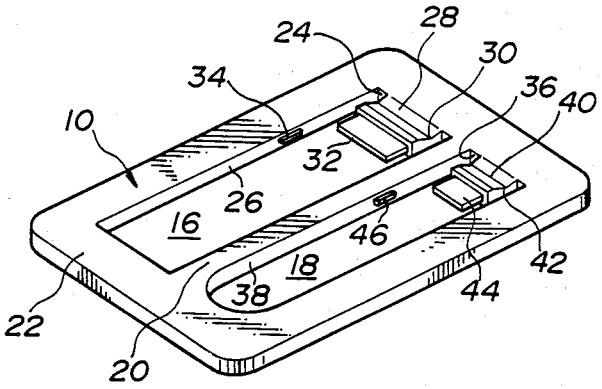
FIG. 2 is a perspective view of a holder body of the assembly in FIG. 1.
Figure 3:
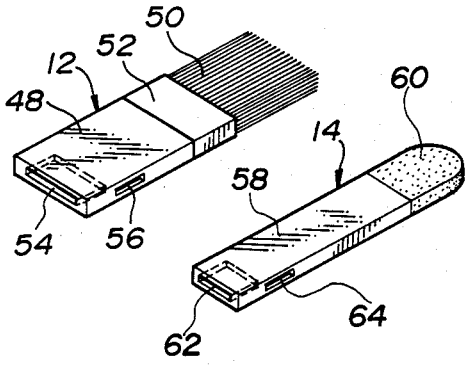
FIG. 3 is a perspective view of tools of the same assembly.
Figure 4A:
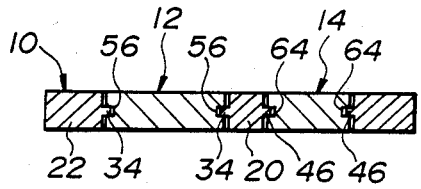
FIGS. 4A and B are a cross section taken along lines IVA—IVA and a longitudinal section taken along lines IVB—IVB in FIG. 1, respectively.
Figure 4B:
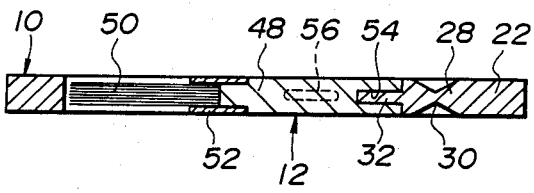

Referring first to FIGS. 1 through 7 of the drawings, a make-up tool and holder assembly according to a first embodiment of the invention generally comprises a holder body 10 and a plurality of make-up tools 12 and 14, which are shown in FIG. 1 as being accommodated within the holder body 10. As best shown in FIGS. 2 and 4, the holder body 10 is in the form of a rectangular plate with its thickness substantially equal to the thickness of tools 12, 14. Formed in the body 10 through its entire thickness are a first cavity 16 for accommodating the tool 12 therein, and a second cavity 18 for accommodating the tool 14 therein. These cavities are arranged side-by-side and separated from each other by a partition 20 which is integral with the marginal portion 22 of the body 10.

The first cavity 16 is of an elongated rectangular shape in plane view and is thus defined by a pair of transverse walls 24 and a pair of longitudinal walls 26. A projection 28 is formed on one of the transverse walls 24, i.e. on the right hand wall in the illustrated embodiment, to extend into the first cavity 16 and has a width less than that of the caviity 16 so that it is spaced from the longitudinal walls 26. As seen from FIG. 4B, the thickness of this projection 28 is reduced toward thel ongitudinal center thereof to provide a flexible hinge portion 30 which permits the projection 28 to bend upwardly and downwardly beyond the plane of the holder body 10. A plug member 32 of a thin plate-shape projects from the inner end of the projection 28, it being adapted to fit into the tool 12 as hereinafter described. Further, each longitudinal wall 26 is formed thereon with a small protrusion 34 for supplemental engagement with the tool 12.

Similarly, a projection 40 extends from the right-hand transverse wall 36 defining the second cavity 18 and has a flexible hinge portion 42, a plug member 44 for the tool 14 extending from the anner end of the projection 40. Each longitudinal wall 38 has a small protrusion 41. The wall defining the left-hand end of the cavity 16 is rounded to conform with a round end of the to/l 14.

As shown in FIG. 3, the tool 12 is a brush for applying a powder or other cosmetic eaterial to a human face, and includes a base portion 48 and natural or synthetic fibers 50 attached to one end of the base portion 48 by means of a band member 52. The other end of the base portion 48 is formed with a slot 54 into which the plug member 32 of the body 10 is adapted to fit for holding the tool 12 in the cavity 16. A recess 56 is provided on each side wall of the base portion 48 to engage with the respective protrusion 34. The tool 14 is intended to be used for a different sort of cosmetic material, such as a rouge, and comprises a base portion 58 and a head 60 of soft rubber or sponge attached to one end of the base portion 58. Similar to the tool 12, a slot 62 is formed in the other end of the base portion 58 for receiving the plug member 44 while a recess 64 is provided on each side wall to engage with the respective protrusion 46.

Figure 7:
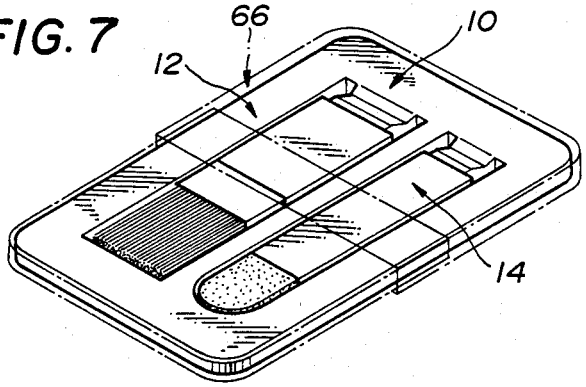
FIG. 7 is a perspective view of the assembly and a casing therefor.

The entire assembly can be accommodated in a casing 66 as shown in FIG. 7 for convenience of carrying the same. Whenever a suer wishes to make up her face, the assembly can easily be taken out from the casing 66.

Figure 5A:
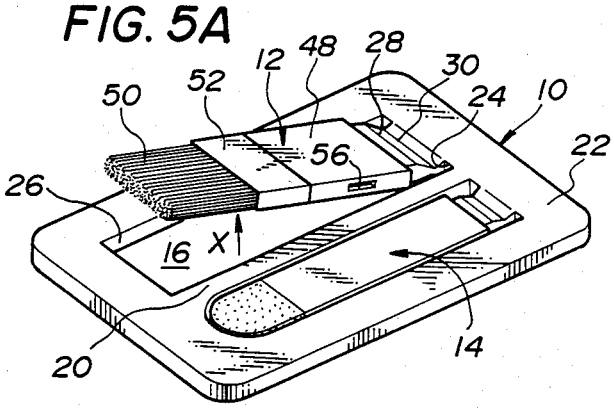
FIGS. 5A and B are a perspective view and a longitudinal section, respectively, illustrating a function of a flexible hinge portion of the assembly.
Figure 5B:
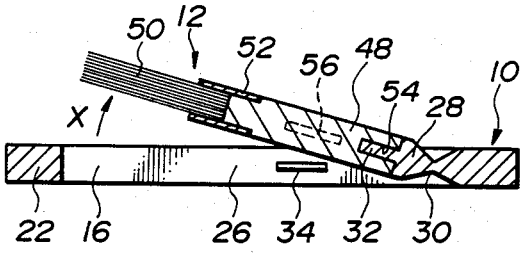
Figure 6A:
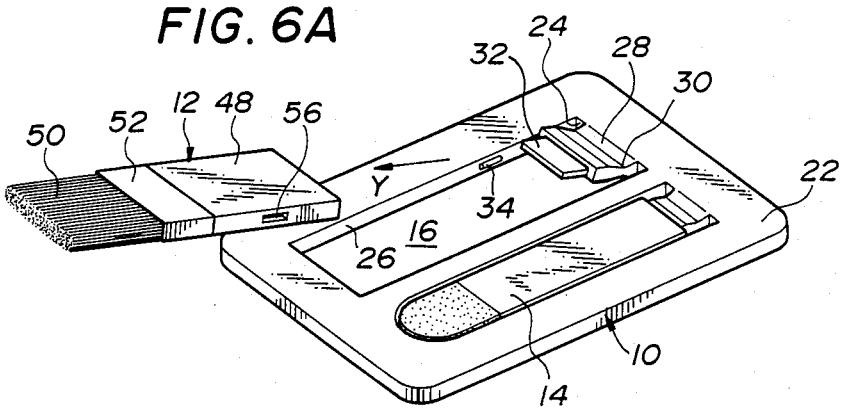
FIGS. 6A and B are views similar to FIGS. 5A and B with the tool being separated from the holder body.
Figure 6B:
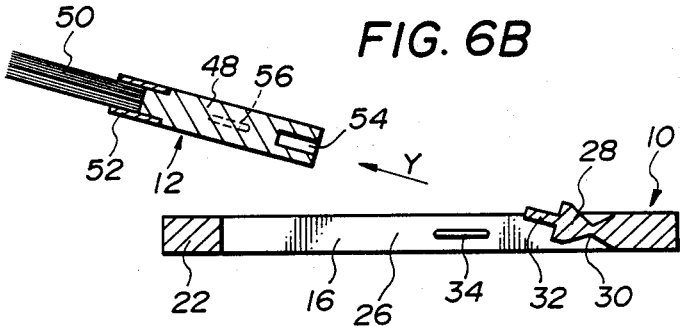

It is now assumed that the tools 12 and 14 are retained in the holder body 10 as shown in FIGS. 1 and 4. When a user desires to use one of the tools, e.g. the tool 12, it is separated from the holder body 10. This can be achieved by following operation. First the base portion 48 of tool 12 is pressed in a direction of arrow X in FIGS. 5A and 5B i.e. in the upward direction, by a user's finger while the holder body10 is gripped by the other hand. Such a pressure causes the protrusions 34 of the body 10 to disengage from the recesses 56 of the tool 12 and at the same time causes the projection 28, which is connected to the tool 12 through the plug member 32, to bend at the hinge portion 30 in such a manner as to lift the tool 12 over the plane of the body 10 as shown in FIGS. 5A and 5B. Thereafter, the tool 12 is pulled in a direction of arrow Y in FIG. 6 to release the engagement between the plug member 32 and the slot 54 and to separate the tool 12 from the holder body 10.

After use, the tool 12 is again accommodated in the holder body 10 by the reverse of the above operations, that is, by first fitting the base portion 48 over the plug member 32 and then pressing the base portion 48 to engage the protrusions 34 with the recesses 56. It is apparent that the tool 14 can be separated from and accommodated into the holder body 10 by the same operations as discussed above regarding the tool 12.

The plug-slot structures may be reversed, that is, the projection 28 may be formed with a slot and the base portion 48 may have a plug member adapted to fit in the slot. Also, the number of cavities in the holder body 10 and the number of tools to be accommodated therein are optional and may be more than two.

As mentioned above, any desired tool can be used in a form totally separated from the holder body 10, thus improving operability of the tool. The tools 12 and 14 are separated from and attached to the holder body 10 by simple operations, particularly due to provison of the flexible hinge portions 30 and 42. Further, it is sufficient that the holder body 10 is as tihck as the tools 12 and 14, which enables the entire assembly to be made as thin as possible for convenience of carriage.

Figure 8:
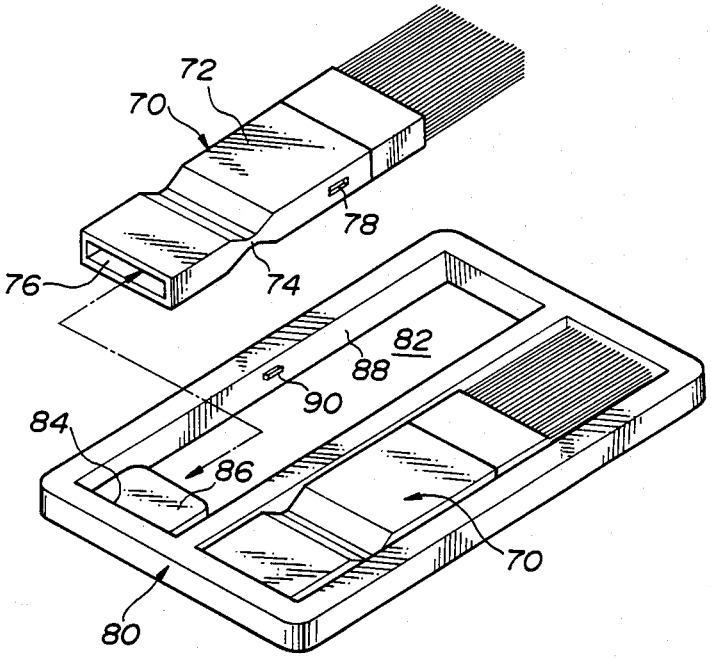
FIG. 8 is a perspective view illustrating an assembly according to a second embodiment of the invention.

A second embodiment of the invention illustrated in FIG. 8 is similar to the first embodiment, except that a flexible hinge portion is provided in a tool itself. Thus, a tool 70, i.e. a brush in the illustrated example, has a base portion 72 with a reduced thickness portion 74 to provide the flexible hinge portion for permitting the base portion 72 to bend thereat. A holder body 80 has a pair of cavities 82 each for accommodating a respective tool 70, and a plug member 86 extends from one of the transverse walls 84 defining the cavity 82 to fit into a slot 76 of the tool 70. Formed on each longitudinal wall 88 is a protrusion 90 adapted to engage with a recess 78 of the tool 70, as in the first embodiment.

Figure 9:
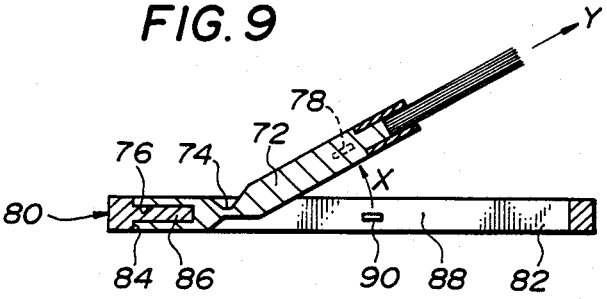
FIG. 9 is a longitudinal section of the same assembly illustrating a manner of separation of tool from a holder body.

When it is desired to use the tool 70 accommodated in the holder body 80, a pressure is applied to the tool 70 in the direction of arrow X in FIG. 9 so that the base portion 72 is bent at the hinge portion 74 while releasing the engagement between the protrusion 90 and the recess 78. Thereafter, the tool 70 can be separated from the holder body 80 by simply pulling the base portion 74 in the direction Y. The two identical tools (i.e. brushes) 70 may be used for coating differently colored powders on a face, for example.

Figure 10:
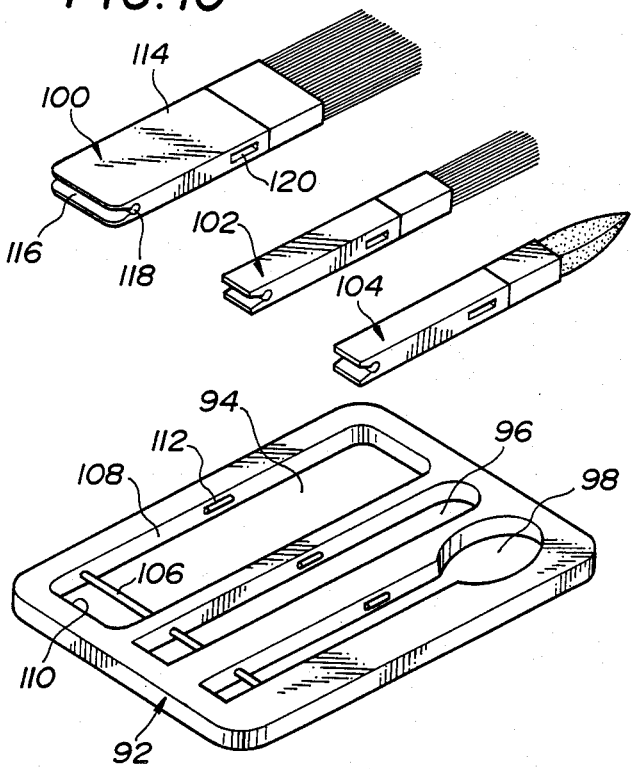
FIG. 10 is an exploded perspective view illustrating an assembly according to a third embodiment of the invention.
Figure 11A:
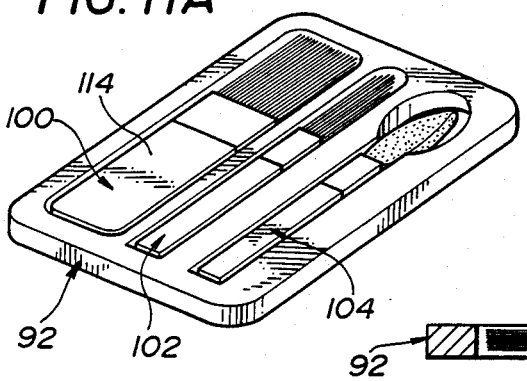
FIGS. 11A and B are a perspective view and a longitudinal section, respectively, of the assembly in FIG. 10.
Figure 11B:
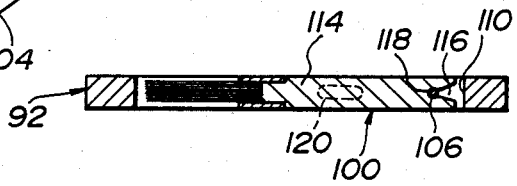

FIGS. 10 through 12 illustrate a third embodiment of the invention, in which a holder body 92 includes three cvities 94, 96 and 98 for accommodating three different tools 100, 102 and 104, respectively, the tool 102 being a small brush for make-up of a narrow area. In the cavity 94 a spindle 106 extends transversely between the longitudinal walls 108 at a positio adjacent one of the transverse walls 110, and a protrusion 112 is provided on each longitudinal wall 108. A base portion 114 of the tool 100 has at its end remote from the fibers a groove 116 the width of which is grdually reduced toward its inner end where the groove 116 is connected to a semicircular hole 118. Groove 116 and hole 118 extend between the side walls of the base portion 114, so that the spindle 106 may fit into the hole 118 through the groove 116 for pivotably securing the tool 100 in the cavity 94 as shown in FIG. 11B. A recess 120 is formed on each side of the base portion 114 to engage with the respective protrusion 112. The other cavities 96, 98 and tools 102, 104 have similar structures and further description thereof will be omitted.

Figure 12A:
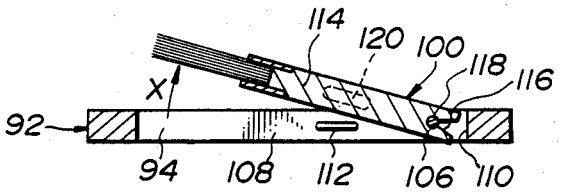
FIGS. 12A and B are longitudinal sections illustrating a manner of separation of a tool.
Figure 12B:
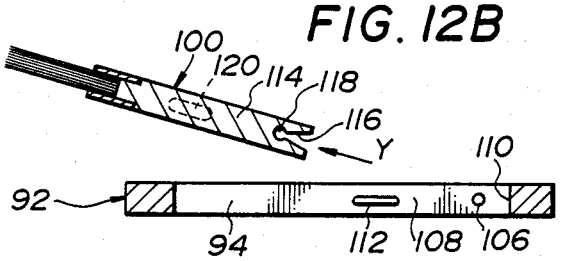

Assuming now that the tools are accommodated in the respective cavities as illustrated in FIG. 11A, a pressure in the direction X in FIG. 12A applied to any desired tool, i.e. the tool 100 in the illustrated example, causes that tool to rotate about the spindle 106 while releasing the protrusion-recess engagement. Thereafter, by pulling the tool 100 in the direction Y in FIG. 12B the spindle 106 is disengaged from the hole 118 by slightly expanding the groove 116, permitting the tool 100 to separate from the holder body 92. As the inner end of groove 116 has a dimension slightly smaller than the diameter of the spindle 106, andy accidental separation of the tool 100 is prevented in cooperation with the protrusion 112 and recess 120.

Figure 13:
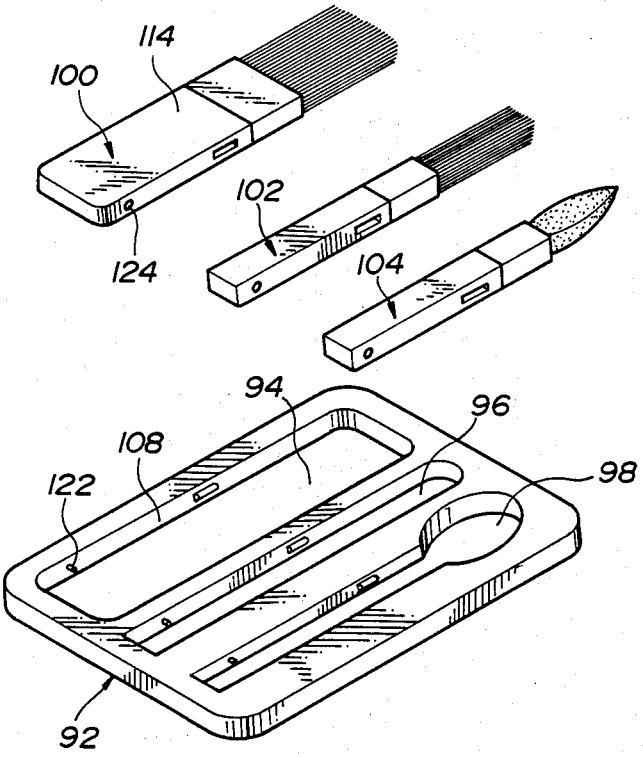
FIG. 13 is a view similar to FIG. 10 illustrating a modified form thereof.

In a modified form illustrated in FIG. 13, a pair of bosses 122 are provided on the respective longitudinal walls 108 instead of the spindle 106, while a pair of bores 124 are drilled in the respective side walls of the base portion 114. The tool can be pivotably secured in the cavity by fitting the bosses 122 into the bores 124 while resiliently deforming the marginal portion of the holder body 92.

Figure 14:
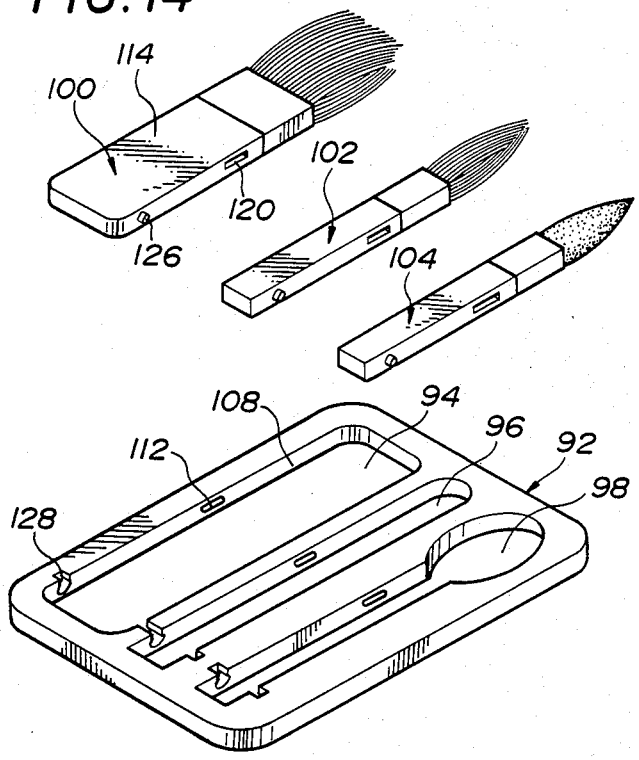
FIG. 14 is also a similar view illustrating another modified form of the assembly.
Figure 15:
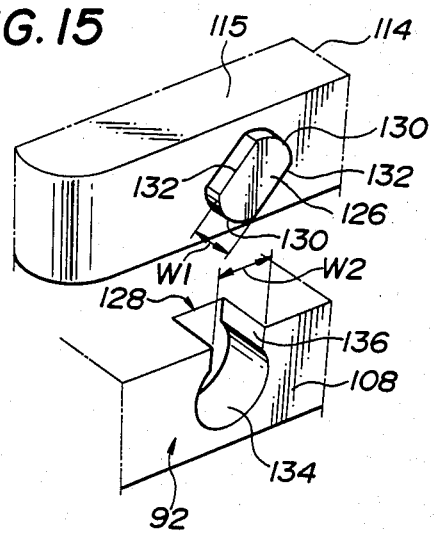
FIG. 15 is an enlarged perspective view illustrating a connecting portion thereof.

Another modification of the assembly is shown in FIG. 14, in which the base portion 114 has a boss 126 on each side wall thereof whle a groove 128 for receiving the respective boss 126 is formed in each longitudinal wall 108 defining the cavity. As best shown in FIG. 15, the boss 126 is in the shape of a flat barrel defined by bulged edges 130 and linear edges 132 with its longitudinal axis being oblique with respect to the upper surface 115 of the base portion 114, and has a width W1 defined between the linear edges 132. The groove 128 comprises a semicircular section 134 of a dimension sufficient to receive the boss 126 therein and a vertically extending entrance 136 having a width W2 which is slightly larger than the width W1 of the boss 126. This entrance section 136 extends to the upper surface of the holder body 92 so as to allow the boss 126 to fit into the semicircular section 136 through the entrance 136.

Figure 16A:
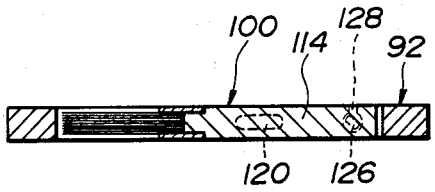
FIGS. 16A and B are a longitudinal section and an enlarged fragmentary view, respectively, of the assembly in FIG. 14.
Figure 16B:
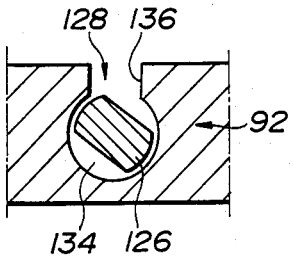
Figure 17A:
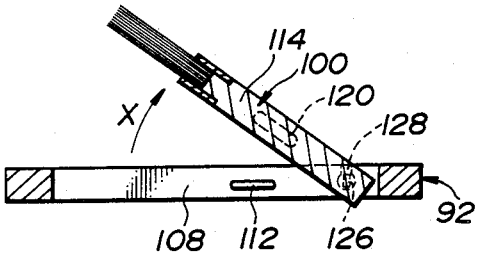
FIGS. 17A and B respectively are views similar to FIGS. 16A and B with a tool being rotated to a separating position.
Figure 17B:
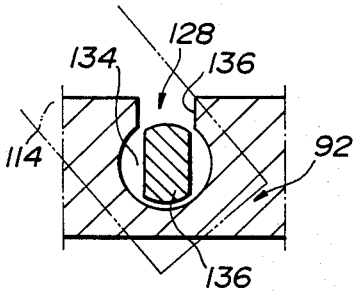
Figure 18:
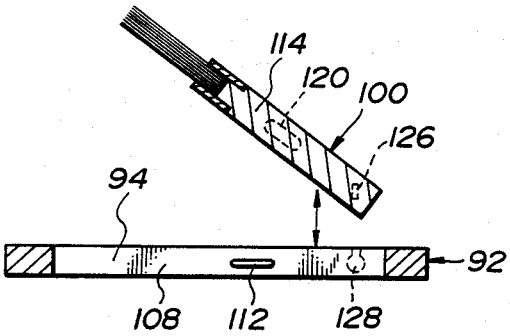
FIG. 18 is a longitudinal section with the tool being separation from a holder body.

In FIGS. 16A and 16B the tool is accommodated in the cavity of the holder body 92. In order to take out the tool, a pressure is applied thereto in such a manner as to rotate the base portion 114 in the direction X in FIG. 17A while releasing the engagement at 112 and 120. The base portion 114 is rotated until it is inclined at a certain angle with the holder body 92 and until the boss 126 takes an upright position where it aligns with the entrance section 136 of the groove 128 (FIG. 17B). Thereafter, by pulling the tool upwardly the boss 126 is released from the groove 128 to separate the tool from the holder body 92 as shown in FIG. 18. The arrangement that the boss 126 is inclined and normally does not align with the groove entrance 136, prevents the tool from accidentally separting from the holder body 92.

Figures 19, 20, 21:
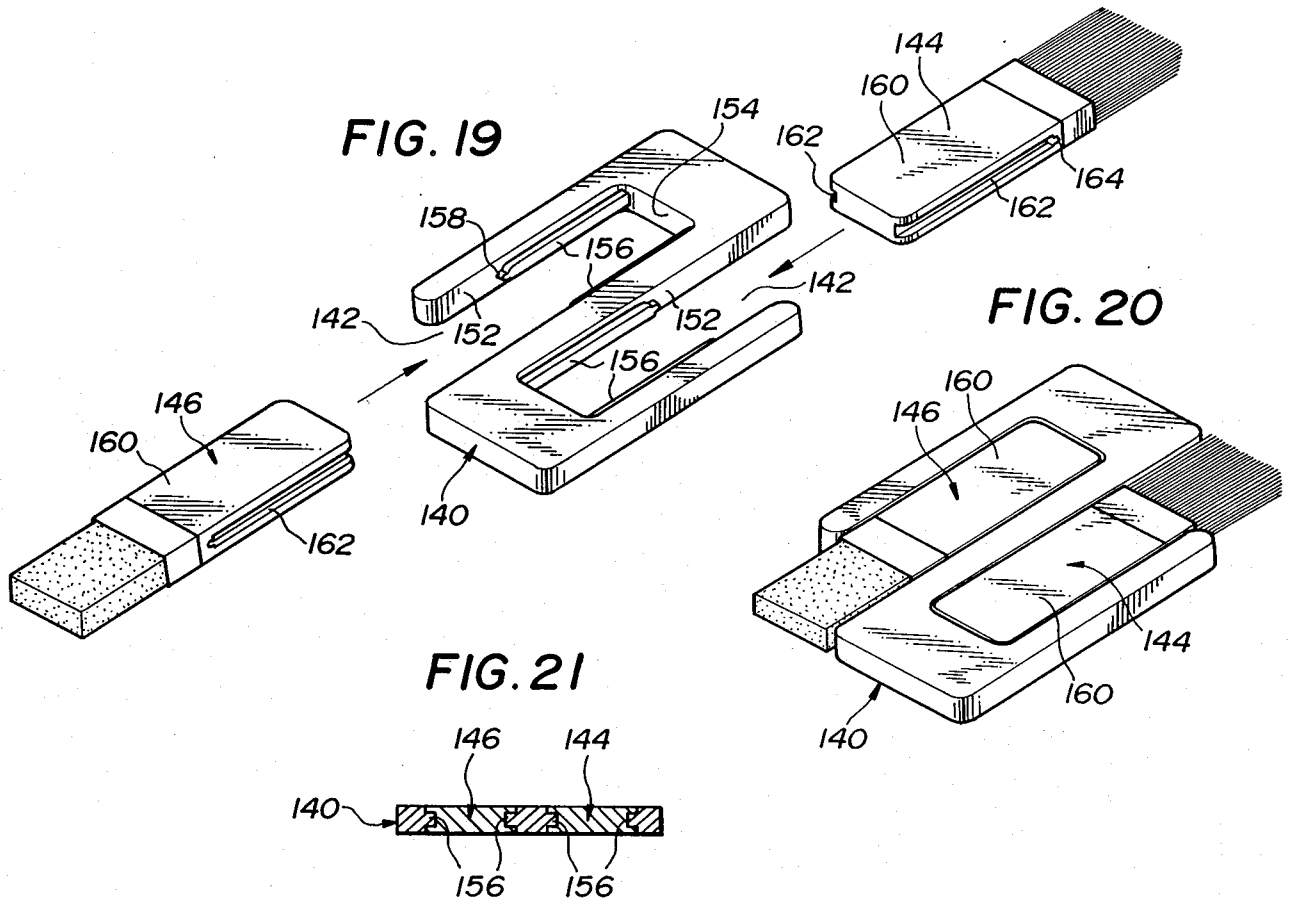
FIG. 19 is an exploded perspective view of an assembly according to a fourth embodiment of the invention.
FIG. 20 is a perspective view thereof in an assembled form.
FIG. 21 is a cross section thereof.

A fgurth embodiment as illustrated in FIGS. 19 through 21 includes a holder body 140 which has a pair of cavities 142 for accommodatang two tools 144 and 146 having different heads. Each cavity 142 is three-sided, that is, it is defined by a pair of longitudinal walls 152 and one transverse wall 154 white the other transverse side is open. In the illustrated example the cavities are oppositely opened, thus rendering the holder body 140 of a shape of the letter Z or reversed S in plan view. If desired, however, these cavities may open in the same direction. Formed on each longitudinal wall 152 is an elongated projection or rib 156 which has at its tip end a small protrusion 158. A base portion 160 of each tool has at the respective side walls thereof a pair of slits 162 and recesses 164 formed on the inner end walls defining the slits 162. The protrusion 158 is adapted to engage with the recess 164 when the rib 156 is slidably fitted into the slit 162 for securing the tool in the cavity.

When it is desired to use the tool that is accommodated in the holder body as shown in FIGS. 20 and 21, the tool can easily be separated from the holder body 140 by pulling the tool outwardly through the open end of the cavity with the ribs 156 sliding relative to the slits 162. After completing a make-up operation, a user may simply insert the tool into the cavity.

In any of the above embodiments, any desired tool can be used alone separately from other tools and the holder body, and this facilitates a make-up operation by a user. The user can separate the tool from and attach it to the holder body by simple operations. Further, the holder body can be as thick as the tools, enablign the entire assembly to be thin for convenience of carriage.

Although the present invention has been described with reference to preferred embodiments thereof, many modifications and alterations may be made within the spirit of the invention.

What is claimed is:

1. A make-up tool and holder assembly comprising:
   a holder body substantially in the shape of a plate;
   a plurality of cavities formed in said holder body through the entire thickness thereof, each said cavity being entirely surrounded by marginal walls of said holder body;
   a plurality of tools each having at one end thereof a make-up head, each said tool having a dimension capable of being accommodated in a respective said cavity; and
   means for securing each said tool in the respective said cavity in a detachable manner, said securing means including a slot formed in said tool at an end thereof opposite to said head, a plug member formed on a respective said marginal wall defining said cavity and adapted to fit in said slot, and a flexible hinge portion for permitting at least a part of said tool including said head to project over said holder body.

2. An assembly as claimed in claim 1, wherein said securing means further comprises a projection extending from said respective marginal wall into said cavity, said plug member extending from an inner end of said projection, and wherein said hinge portion comprises a reduced thickness portion of said projection.

3. An assembly as claimed in claim 1, wherein said hinge portion comprises a reduced thickness portion formed in said tool adjacent said slot.

4. An assembly as claimed in claim 1, wherein said securing means further includes a recess formed in each side wall of said tool and a protrusion formed on each corresponding side wall of said cavity to engage with said recess.

5. An assembly as claimed in claim 1, wherein said tool is rectangular in plan view and said head is provided on one transverse end thereof.

6. An assembly as claimed in claim 1, wherein said plurality of tools have different said heads for use with different sorts of cosmetic materials.

* * * * *